US008306468B2

(12) United States Patent
Matsubara et al.

(10) Patent No.: US 8,306,468 B2
(45) Date of Patent: Nov. 6, 2012

(54) LASER FIXING APPARATUS AND IMAGE FORMING APPARATUS

(75) Inventors: Takashi Matsubara, Kanagawa (JP); Makoto Furuki, Kanagawa (JP); Naoyuki Egusa, Kanagawa (JP); Tetsuro Kodera, Kanagawa (JP); Miho Watanabe, Kanagawa (JP); Shinji Hasegawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 305 days.

(21) Appl. No.: 12/702,709

(22) Filed: Feb. 9, 2010

(65) Prior Publication Data

US 2011/0044740 A1 Feb. 24, 2011

(30) Foreign Application Priority Data

Aug. 20, 2009 (JP) ..... 2009-190913

(51) Int. Cl.
*G03G 15/20* (2006.01)

(52) U.S. Cl. ..... 399/335

(58) Field of Classification Search ..... 399/122, 399/320, 335–338; 219/216, 220, 619
See application file for complete search history.

(56) References Cited

U.S. PATENT DOCUMENTS

| | | | | |
|---|---|---|---|---|
| 5,113,223 | A * | 5/1992 | Theodoulou et al. | 219/220 |
| 2008/0101832 | A1 | 5/2008 | Yaoi et al. | |
| 2008/0199230 | A1 * | 8/2008 | Kawano | 399/322 |

FOREIGN PATENT DOCUMENTS

| | | | |
|---|---|---|---|
| JP | 59-95568 | A | 6/1984 |
| JP | 3016685 | B2 | 12/1999 |
| JP | 2007-57903 | A | 3/2007 |

* cited by examiner

*Primary Examiner* — Hoan Tran
(74) *Attorney, Agent, or Firm* — Sughrue Mion, PLLC

(57) ABSTRACT

A laser fixing apparatus includes: a laser light generator that generates laser light to be projected onto a recording medium. A first condenser reflects and condenses the light generated by reflection of the laser light at an irradiation position of the recording medium, such that the reflected and condensed light is re-projected at the irradiation position and/or near the irradiation position.

8 Claims, 9 Drawing Sheets

LASER FIXING APPARATUS AND IMAGE FORMING APPARATUS

CROSS-REFERENCE TO RELATED APPLICATION

This application is based on and claims priority under 35 USC 119 from Japanese Patent Application No. 2009-190913 filed on Aug. 20, 2009.

BACKGROUND

1. Technical Field

The present invention relates to a laser fixing apparatus and an image forming apparatus.

2. Related Art

In image forming apparatuses employing powdered toner, such a type is widely used that a toner image formed by adhesion of toner is transferred from an image carrier onto a recording medium and then the toner image is fixed to the recording medium. Then, known methods of fixing a toner image include a contact type and a non-contact type.

In the contact type, for example, an endless heating member whose peripheral surface is to be heated and a pressurizing member in contact with the heating member are provided. Then, in a state that a recording medium is pinched between these members, a toner image is heated and pressurized so that the toner image is fixed to the recording medium. On the other hand, in comparison with the apparatuses of contact type described above, fixing apparatuses of non-contact type do not contact with recording media and hence have an advantage in the universality of recording media and in achieving high speeds. In such fixing apparatuses of non-contact type, a flash lamp arranged opposite to a transporting path for a recording medium is intermittently turned ON so that a toner image on the recording medium under transport is heated and fixed.

SUMMARY

According to an aspect of the invention, a laser fixing apparatus includes: a laser light generator that generates laser light to be projected onto a recording medium; and a first condenser that reflects and condenses the light generated by reflection of the laser light at an irradiation position of the recording medium, such that the reflected and condensed light is re-projected at the irradiation position and/or near the irradiation position.

BRIEF DESCRIPTION OF THE DRAWINGS

Embodiments of the invention will be described in detail based on the following figures, wherein.

DETAILED DESCRIPTION

Figure 1:
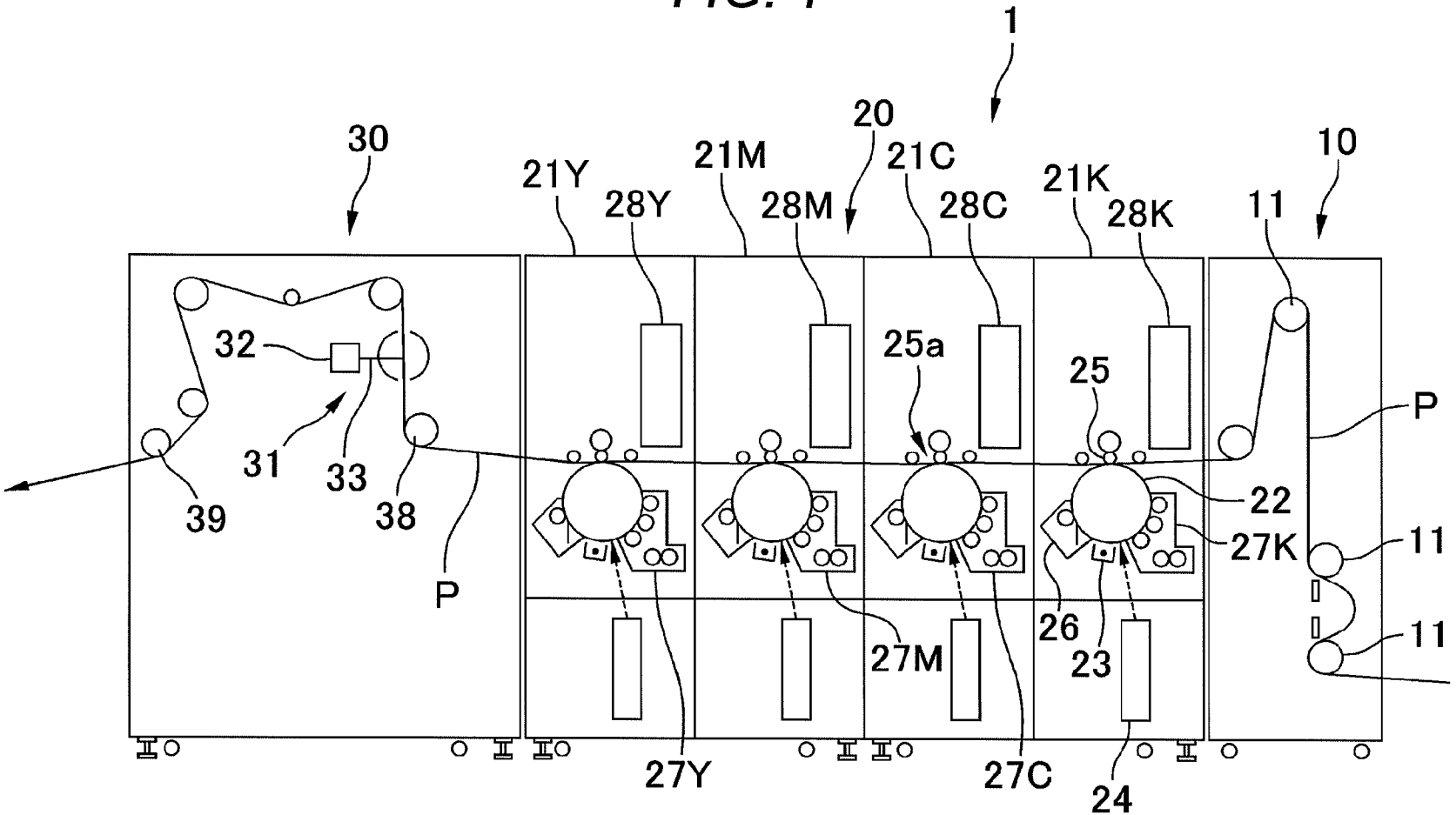
FIG. 1 is a schematic configuration diagram of an image forming apparatus according to an exemplary embodiment of the present invention.

FIG. 1 is a schematic configuration diagram of an image forming apparatus according to an exemplary embodiment of the present invention.

This image forming apparatus 1 is a large-size apparatus for forming an image on continuous paper (continuous printing paper also known as continuous form sheets; referred to as "continuous paper", hereinafter) serving as a recording medium and is constructed from: a paper transporting section 10 for transporting and supplying continuous paper P; an image forming section 20 for forming and transferring an image onto the continuous paper P; and a fixing section 30 for fixing the transferred image.

The paper transporting section 10 has plural of wound-around rollers 11 around each of which the continuous paper P is wound and transported. Thus, the continuous paper P is transported to the image forming section 20 in a state that a tension is imparted.

In the image forming section 20, four image forming units 21K, 21C, 21M, and 21Y for transferring toner (image forming material) of black (K), cyan (C), magenta (M), and yellow (Y), respectively in this order from the upstream so as to form a toner image serving as a visible image are arranged at almost equal intervals along the direction of transport of the continuous paper.

Each of the image forming units 21K, 21C, 21M, and 21Y has a photosensitive material drum 22 in which a photoconductivity layer is formed on the outer peripheral surface of a cylindrical member composed of conductive material. Then, around the photosensitive material drum 22, arranged are: an electrostatic charging unit 23 for electrostaically charging uniformly the surface of the photosensitive material drum 22; an exposure device 24 for projecting image light onto the electrostaically charged photosensitive material drum 22 so as to form a latent image on the surface; a developing unit 27 for transferring toner to the latent image on the photosensitive material drum 22 so as to form a toner image; a transfer roller 25 arranged opposite to the photosensitive material drum 22 and transferring onto continuous paper the toner image formed on the photosensitive material drum; and a cleaning device 26 for removing toner remaining on the photosensitive material drum 22 after the toner image is transferred.

Here, in each of the four image forming units 21K, 21C, 21M, and 21Y, the color of the toner accommodated in the developing unit 27 is different from those of others. The other points in the configuration are the same. Then, above the developing units 27K, 27C, 27M, and 27Y, toner supply containers 28K, 28C, 28M, and 28Y each accommodating toner of a color corresponding to that of the toner in each developing unit are arranged so that toner consumed in association with development is supplied to each developing unit.

The fixing section 30 provided downstream the image forming section 20 has: a laser fixing apparatus 31 for fixing the not-yet-fixed toner image transferred onto the continuous paper by the image forming section 20; a transport roller 38 around which the continuous paper P onto which a toner image has been transferred is wound and which guides the continuous paper to the laser fixing apparatus 31; and a paper ejection roller 39 for ejecting to the outside of the apparatus the continuous paper P to which the toner image has been fixed.

In this image forming apparatus, when image formation operation is started, the photosensitive material drum 22 is electrostatically charged almost uniformly into a negative polarity by the electrostatic charging unit 23. Then, on the basis of image data, the exposure device 24 projects image light onto the peripheral surface of the electrostaically charged photosensitive material drum 22, so that on the surface of the photosensitive material drum 22, a latent image is formed on the basis of a potential difference between an exposure part and a non-exposure part. In the developing unit 27, a thin layer of developing powder is formed on the peripheral surface of the development roller. Then, in association with the revolution of the development roller, the developing powder in the form of a thin layer is transported to the development position opposite to the peripheral surface of the photosensitive material drum 22. At the development position, an electric field is formed between the photosensitive material drum 22 and the development roller. Thus, within this electric field, the toner on the development roller is transferred to the latent image on the photosensitive material drum, so that a toner image is formed. Then, in association with the revolution of the photosensitive material drum 22, the toner image formed as described here is transported to the transfer and pressurization section 25*a* where the transfer roller 25 is pressed against.

On the other hand, the continuous paper P transported from the paper transport section 10 is fed into the transfer and pressurization section 25*a*. In the transfer and pressurization section 25*a*, an electric field is formed by a transfer bias voltage. Then, within this electric field, the toner image is transferred to the continuous paper P. The continuous paper P is transported sequentially to the transfer and pressurization section 25*a* of each image forming unit 21, so that toner images of individual colors are transferred and stacked.

The continuous paper P onto which a toner image has been transferred is transported around the transport roller 38 and sent to the laser fixing apparatus 31 in a state that the toner image is held. In the laser fixing apparatus 31, laser light 33 is projected onto the continuous paper P so as to heat and fix the toner. The continuous paper P on which the toner image has been fixed is ejected to the outside of the apparatus by the paper ejection roller 39.

Next, the laser fixing apparatus 31 employed in the image forming apparatus is described below.

Figure 2:
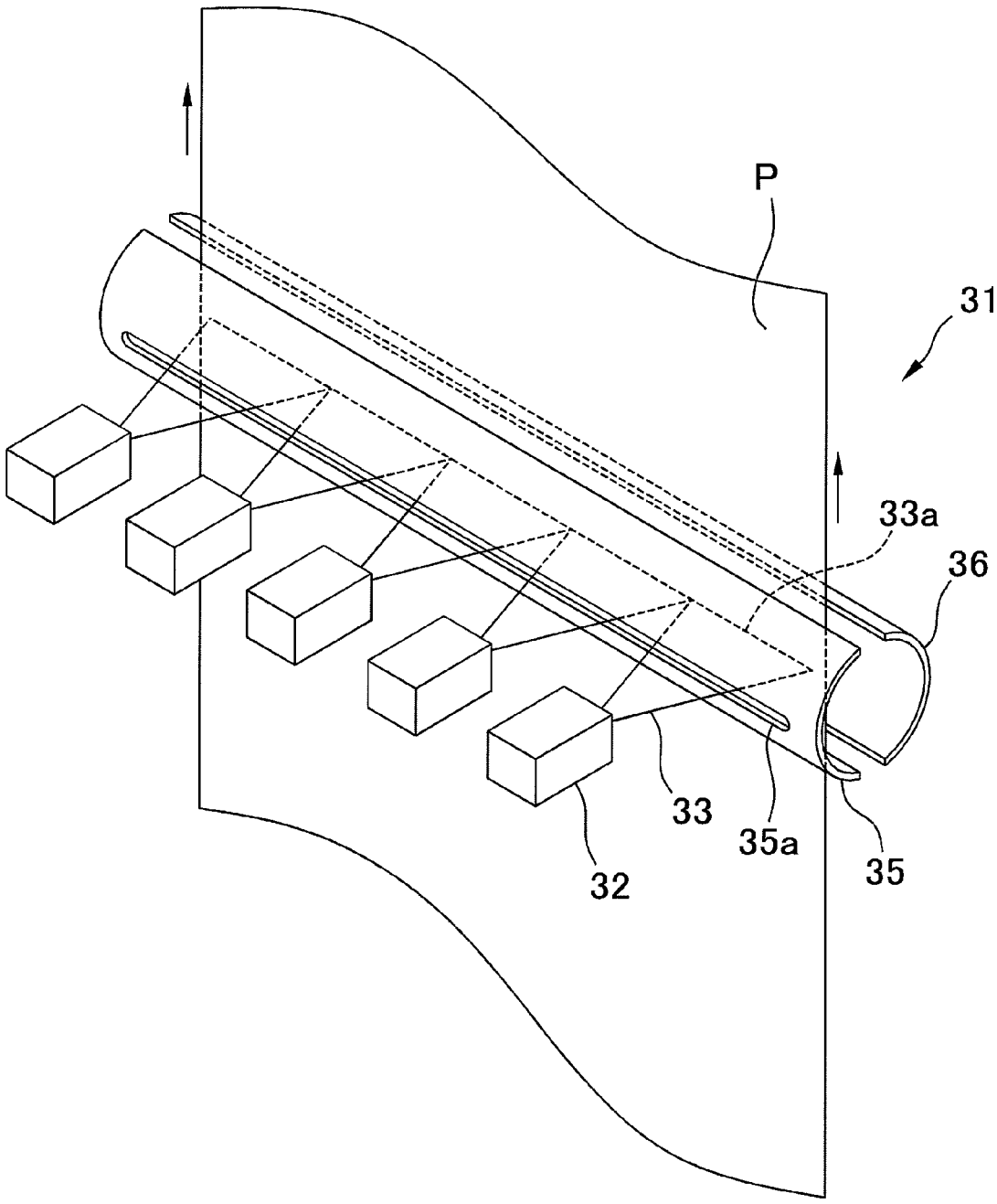
FIG. 2 is a schematic perspective view of a laser fixing apparatus according to an exemplary embodiment of the present invention, which is employed in an image forming apparatus shown in FIG. 1.
Figure 3:
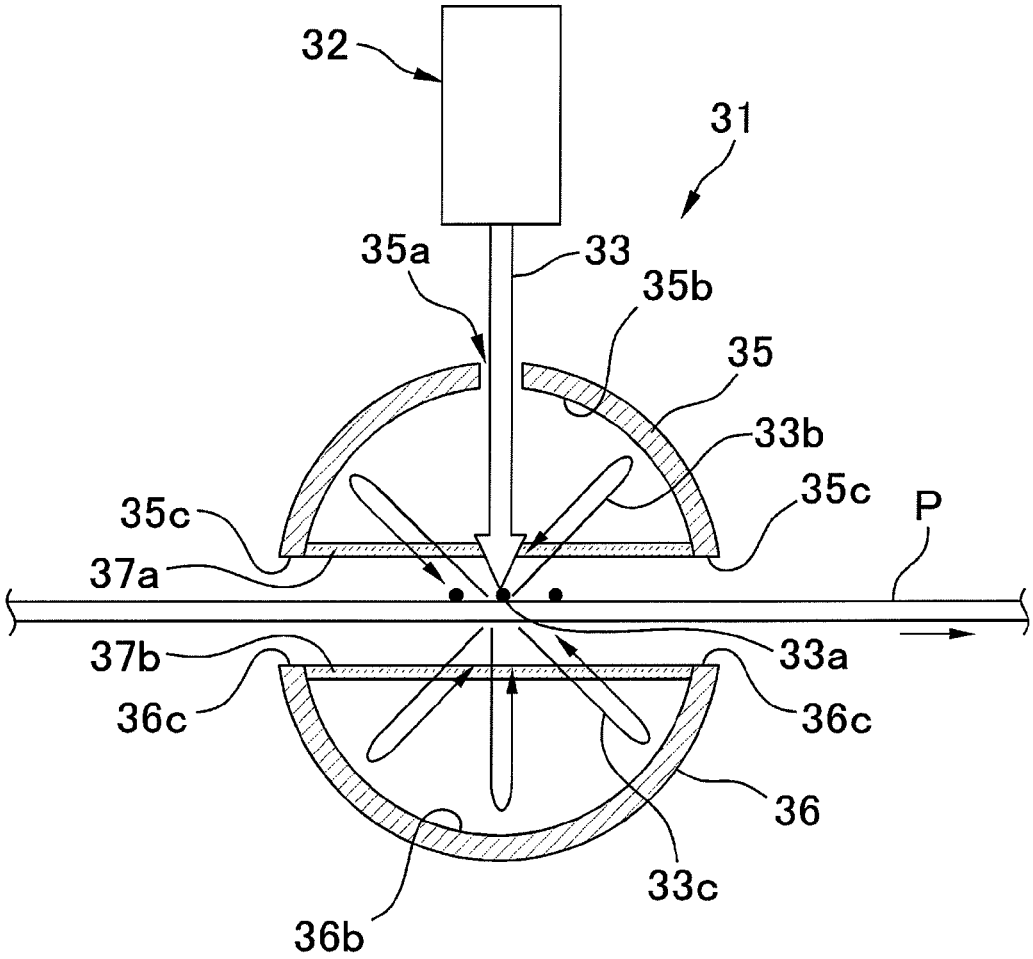
FIG. 3 is a schematic sectional view of a laser fixing apparatus shown in FIG. 2.

FIG. 2 is a schematic perspective view of a laser fixing apparatus 31 according to an exemplary embodiment of the present invention. FIG. 3 is a schematic sectional view.

The principal part of this laser fixing apparatus 31 is constructed from: a laser light generator 32 for projecting laser light 33 over the entire width of the region where the image is transferred in the continuous paper P that is moving; a condenser 35 for causing scattered light 33*b* generated by the laser light 33 reflected by the continuous paper P to be projected again onto the continuous paper P; a rear side condenser 36 for reflecting light 33*c* transmitted and scattered by the continuous paper P and thereby condensing the light 33*c* from the rear side of the continuous paper P into the irradiation position; and glass plates 37*a* and 37*b* each composed of a light transmitting body for covering each of the reflecting surfaces 35*b* and 36*b* of the condenser 35 and the rear side condenser 36.

Plural of the laser light generators 32 are arranged in the width direction of the continuous paper P (a direction perpendicular to the transport direction). Then, the laser light 33 emitted from the laser light generators 32 is projected onto the continuous paper P within a region set up in advance in the direction of moving of the continuous paper P. Further, plural of laser light generators 32 are arranged in the width direction of the continuous paper P that is moving, such that the irradiation energy is distributed almost uniformly over the entire width of the region where the image is transferred. Then, the irradiation energy is adjusted such that the toner passing through the irradiation region of the laser light 33 is heated and fixed onto the continuous paper P.

Here, in the present exemplary embodiment, semiconductor laser devices are employed so that irradiation is achieved with a beam width of approximately 1 mm in the direction of transport of the continuous paper P.

The condenser 35 is composed of a metal mirror whose reflecting surface 35*b* has the shape of a concave cylindrical surface, and is arranged such that the reflecting surface 35*b* is opposite to the continuous paper P. Then, the condenser 35 is supported such that the center axis of the cylindrical surface is almost perpendicular to the direction of transport of the continuous paper P. In the center part in the circumferential direction of the reflecting surface 35*b* having the shape of a cylindrical surface, a slit 35*a* (an example of an entrance opening) formed in the shape of an opening elongated in the axial direction is provided. Thus, the laser light 33 emitted toward the continuous paper P passes through the slit 35*a*, and is then transmitted through the glass plate 37*a* and then projected onto the continuous paper P. Here, the light source is located in the outside of the condenser (on the side reverse to the reflecting surface), and hence a possibility is avoided that the light source generates a shadow in the reflecting surface. Thus, this configuration is preferable.

The reflecting surface 35*b* of the condenser 35 covers the position where the laser light 33 is first projected onto the continuous paper P, that is, the primary irradiation position 33*a*. Further, in the width direction of the continuous paper P, the entire width of the region where the image is formed is covered. Then, the center axis position of the cylindrical surface of the condenser is set up at the primary irradiation position 33*a* where the laser light is projected onto the continuous paper P, or alternatively near the primary irradiation position. As a result, the condenser 35 repeatedly reflects and condenses a major part of the scattered light 33*b* reflected by the continuous paper, at the primary irradiation position 33*a* or near this position.

Here, the center axis position of the reflecting surface 35*b* having the shape of a cylindrical surface may deviate somewhat in the direction of moving of the continuous paper P or alternatively in a direction perpendicular to the surface of the continuous paper, as long as the scattered light reflected at the primary irradiation position can be condensed near the primary irradiation position.

The description "to condense at the primary irradiation position or near the primary irradiation position" indicates that in comparison with the irradiation energy of the laser light projected primarily, condensation is achieved to an extent that the fixing effect on toner particles, especially, on isolated toner particles, at the primary irradiation position is increased by the additional energy of the light reflected and condensed by the condenser. Thus, in addition to a case that the light condensed by the condenser is projected accurately at the primary irradiation position, the light may be projected at the primary irradiation position and near the position. Further, in the distribution of the irradiation energy of the light condensed by the condenser, the peak position may somewhat deviate from the primary irradiation position.

In the present exemplary embodiment, the radius of the cylindrical surface of the condenser 35 is 50 mm. The gap between each edge 35*c* in the circumferential direction and the continuous paper under transport is 5 mm.

The rear side condenser 36 is composed also of a metal mirror whose reflecting surface 36*b* has the shape of a concave cylindrical surface. On the rear side of the continuous paper P under transport, the condenser 35 is arranged such that the center axis of the cylindrical surface is almost perpendicular to the direction of transport of the continuous paper P. Then, scattered light 33*c* having been transmitted through the continuous paper P at the primary irradiation position 33*a* is reflected toward the rear side of the continuous paper P.

Similarly to the condenser 35, the rear side condenser 36 is formed such as to cover the rear side of the primary irradiation position 33*a* of the continuous paper P and, in the width direction of the continuous paper P, cover the entire width of the region where the image is formed. Further, the center axis position of the cylindrical surface serving as the reflecting surface 36*b* is set up at the primary irradiation position 33*a* where the laser light is projected onto the continuous paper P, or alternatively near the primary irradiation position. As a result, the rear side condenser 36 condenses a major part of the light 33*c* generated by scattering of the laser light transmitted through the continuous paper, at the primary irradiation position 33*a* or near this position on the rear side of the continuous paper.

The glass plates 37*a* and 37*b* are provided such as to cover each of the reflecting surfaces 35*b* and 36*b* of the condenser 35 and the rear side condenser 36. As shown in FIG. 3, the glass plates 37*a* and 37*b* are formed in a plate shape and supported at the two edges 35*c* and 36*c* of the condenser 35 or the rear side condenser 36 in the circumferential directions. Thus, the laser light 33 is transmitted through the glass plate 37*a* and then projected onto the continuous paper P. Then, scattered light 33*b* reflected at the primary irradiation position 33*a* is transmitted through the glass plate 37*a* and then reaches the reflecting surface 35*b* so as to be condensed at the primary irradiation position 33*a*.

Since the glass plates 37*a* and 37*b* are provided such as to cover the condenser 35 and the rear side condenser 36, dirt on the reflecting surfaces of the condensers is avoided. When toner is heated by projection of the laser light 33, components like resin contained in the toner float in the space between the continuous paper P and the condenser 35 or the space between the continuous paper P and the rear side condenser 36. However, since the reflecting surfaces 35*b* and 36*b* of the condenser 35 and the rear side condenser 36 are covered by the glass plates 37*a* and 37*b*, adhesion of dirt is avoided. Cleaning of the reflecting surfaces of the condensers is difficult. Further, in particular, in a case that the condensers are composed of metal mirrors, if components like toner adhere, their removal by cleaning is difficult. However, in the present exemplary embodiment, since reflecting surfaces are covered by glass plates as described above, cleaning is easy and hence dirt having adhered to the glass plates is removed easily.

Next, the operation of the laser light 33 performed on the continuous paper P onto which a toner image has been transferred is described below.

A toner image transferred on the continuous paper P has high density parts and low density parts in a mixed form. In high density parts, toner particles adhere to the continuous paper P in a closely packed manner. In contrast, in low density parts, toner particles adhere to the continuous paper in a dispersed manner. The dispersed toner particles adhering in low density parts include: a group of plural of toner particles mutually aggregated; and a single toner particle adhering in an isolated manner (referred to as an "isolated toner particle", hereinafter). Further, in case of occurrence of fogging (a phenomenon that during the development operation, toner adheres to a non-image region where the toner should intrinsically not adhere), a large number of isolated toner particles are generated.

Figure 4A:
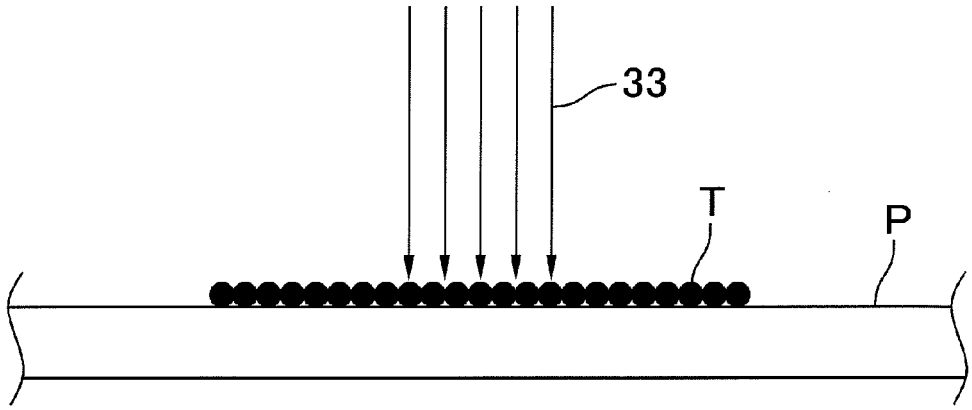
FIGS. 4A-4B are schematic diagrams showing a state that laser light is projected onto continuous paper onto which a toner image has been transferred.
Figure 4B:
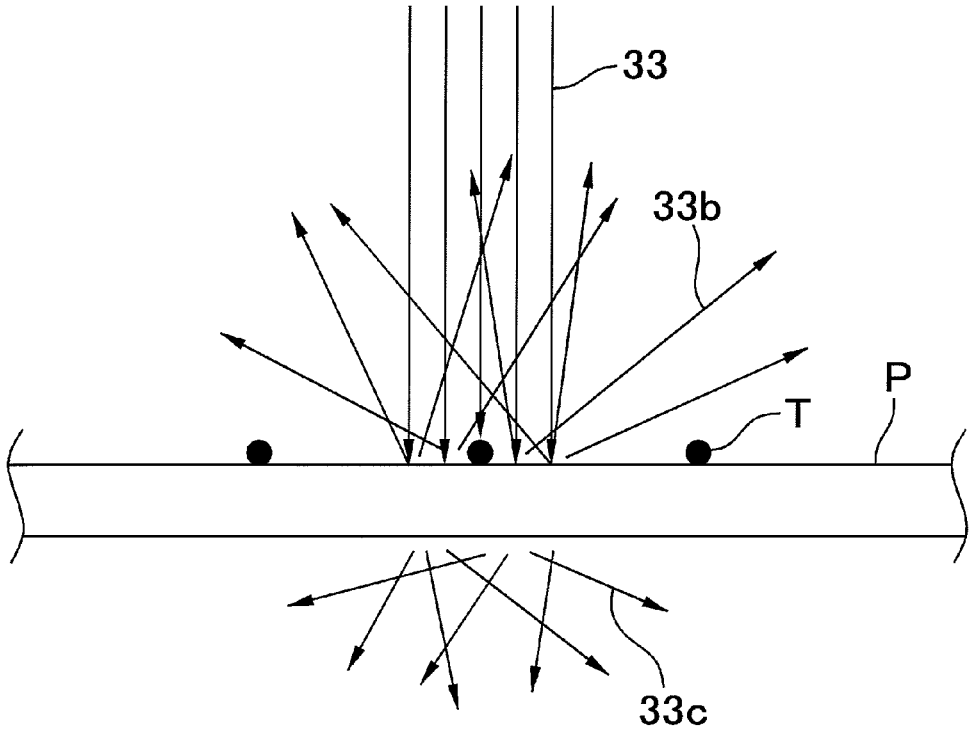

As shown in FIG. 4(*a*), in a high density part, a major part of laser light 33 projected from the laser light generator 32 is projected onto toner particles T, and hence reflected and scattered light is generated merely at a low intensity. Then, the output of the irradiation energy of the laser light generator 32 is adjusted such that in this state, the toner particles T absorb the irradiation energy of the laser light 33 so as to be heated to a temperature suitable for fixing.

In contrast, in low density parts, adhering toner has a low closeness of packing. Thus, as shown in FIG. 4(*b*), when laser light 33 is projected onto toner particles T at the primary irradiation position of the laser light 33, the laser light 33 is projected simultaneously onto the periphery of the toner particles T and then reflected so as to generate scattered light 33*b*. Further, a part of the light is transmitted through the continuous paper P and generates scattered light 33*c* on the rear side. At that time, the irradiation energy of the laser light 33 projected directly onto the toner particles T has no substantial difference from that of toner particles in high density parts. Nevertheless, in contrast to toner particles in high density parts which are formed in a closely packed manner, toner particles in low density parts have larger surface areas of contact with outside air, and hence have higher heat radiation rates and are heated insufficiently in some cases. Thus, poor fixing occurs frequently. In particular, in isolated toner particles adhering in an isolated manner on an individual particle basis, poor fixing caused by insufficient heating occurs frequently.

As such, toner particles in low density parts and isolated toner particles have a possibility that the toner particle is not sufficiently heated by the irradiation energy of the laser light, and hence stays in a not-fixed state. Toner particles in a not-fixed state can adhere to the paper ejection roller 39 and the like so as to cause dirt in the printing paper or in the inside of the apparatus.

On the other hand, with taking into consideration the loss of irradiation energy in low density parts, if the output of the laser light are set up higher, toner particles in high density parts would be heated excessively. This could cause image defects in high density parts or alternatively an increase in scattering of toner resin.

With taking such situations into consideration, in the laser fixing apparatus according to the present exemplary embodiment, the irradiation energy of the laser light 33 is adjusted such that high density parts are fixed appropriately. Further, the condenser 35 and the rear side condenser 36 are arranged on the front side and the rear side of the continuous paper P under transport. As a result, in a high density part, fixing is achieved appropriately. Further, in a low density part, scattered light 33*b* generated by laser light 33 projected onto and reflected by the continuous paper P at the primary irradiation position 33*a* or alternatively light 33*c* transmitted and scattered on the rear side of the continuous paper P is condensed at the primary irradiation position 33*a* of the laser light 33 or near the primary irradiation position, so that irradiation energy is increased for toner particles in a low density part or for isolated toner particles.

That is, in a region where low density parts or isolated toner particles are present, a major part of laser light 33 projected onto the continuous paper P is scattered in the form of reflected light 33*b* or transmitted light 33*c*. The condenser 35 and the rear side condenser 36 condense the reflected light 33*b* and the transmitted light 33*c* at the primary irradiation position 33*a* or near the primary irradiation position such as to be projected onto toner particles T. At that time, the light projected onto the continuous paper near the toner particles generates scattered light, which is condensed by the condenser 35 or the rear side condenser 36 and then projected repeatedly onto the toner particles. This causes an increase in the irradiation energy projected onto the toner particles, so that even toner in a low density part and isolated toner particles are fixed satisfactorily.

In contrast, high density parts have high absorption coefficients for the laser light 33. Thus, reflected light 33*b* and transmitted light 33*c* are generated merely at low intensities at the primary irradiation position 33*a*. Accordingly, the intensity of light reflected by the condenser 35 or by the rear side condenser 36 and then returned to the primary irradiation position 33*a* is low. Thus, merely a low possibility is present that high density parts are heated excessively.

In general, in an image formed by adhesion of toner, high density parts and low density parts are mixed. Then, in the laser fixing apparatus 31, the region where the laser light is projected is as narrow as approximately 1 mm in the direction of moving of the continuous paper P. Then, when the region where the laser light is projected has a high density, reflected light is generated merely at a low intensity and hence the energy of re-irradiation is also low. Further, when the region where the laser light is projected has a low density, scattered light reflected by the continuous paper P and scattered light transmitted through the continuous paper P are generated at higher intensities. This causes an increase in the energy re-projected onto the toner and in the energy re-projected from the rear side of the continuous paper P at the primary irradiation position of the laser light. Thus, satisfactory fixing is achieved both in high density parts and in low density parts.

In the above-mentioned exemplary embodiments, continuous paper has been employed as a recording medium on which an image is formed. Instead, recording paper sheets having been cut into a size according to a general standard may be employed and transported one by one.

Further, the rear side condenser provided on the rear side of the continuous paper may be not employed. Then, the condenser provided on the irradiation side of the laser light may condense, at the primary irradiation position, only the light reflected by the continuous paper.

In the above-mentioned exemplary embodiment, the beam width of the laser light has been approximately 1 mm. However, this beam width may be changed. A metal mirror has been employed in the condenser 35 and the rear side condenser 36.

Instead, a glass mirror fabricated by applying or bonding metal such as aluminum onto the rear surface of a glass material or alternatively a metal film mirror fabricated by vapor deposition of metal may be employed.

Further, in a case that the condenser or the rear side condenser absorbs scattered light and is thereby heated up, a heat sink, a chiller, an air-cooling device, or the like may be provided for suppressing the heat-up.

The glass plates attached to the condenser and the rear side condenser are of an arbitrary configuration, and may be omitted in a case that dirt on the reflecting surfaces does not causes a problem or alternatively glass mirrors are employed in the condensers.

Further, the employed shapes of the glass plates 37*a* and 37*b* are not limited to those adopted in the present exemplary embodiment. That is, arbitrary shapes may be employed as long as the reflecting surfaces 35*b* and 36*b* of the condenser 35 and the rear side condenser 36 are protected from scattered material or the like.

Further, in place of the use of glass plates or alternatively together with the use of glass plates, an air flow generator may be provided so as to generate an air flow between each condenser 35 and the continuous paper P. Further, this air flow may be used also as air-cooling means for suppressing the heat-up of the condenser.

Next, description is given for the difference between the condenser 35 in the above-mentioned exemplary embodiment and a mirror in a fixing apparatus employing a related art flash lamp.

Figure 13A:
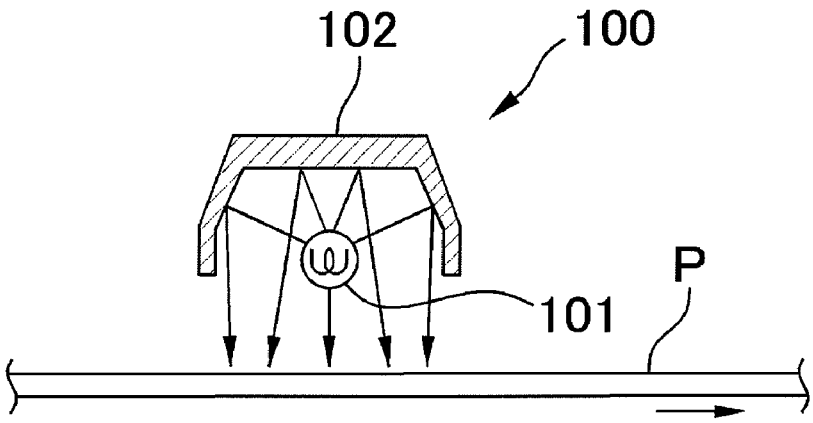
FIGS. 13A-13B are schematic sectional view views showing a related art flash lamp fixing apparatus.
Figure 13B:
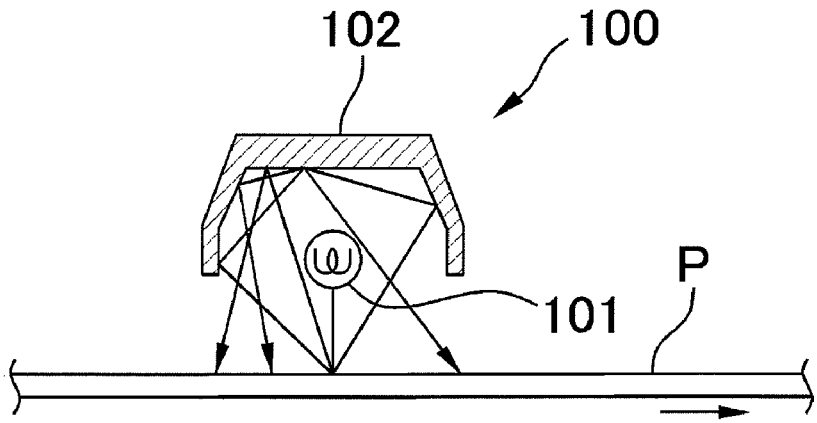

As shown in FIG. 13, in a fixing apparatus 100 employing a related art flash lamp, a flash lamp 101 is arranged in the width direction of the recording medium P under transport. Then, a mirror 102 serving as a condenser is provided such as to cover the rear face and the side faces of the flash lamp 101. As shown in FIG. 13(*a*), the mirror 102 reflects the light of the flash lamp 101 emitted in all directions, especially the light emitted rearward and sideward, such that the light is projected onto the recording medium P uniformly in the entirety. At that time, the light reflected by the mirror 102 is distributed and projected over a large region of the recording medium P opposite to the flash lamp 101. Further, as shown in FIG. 13(*b*), the mirror 102 has also the function of reflecting again the light projected onto and reflected by the recording medium and thereby projecting the light onto the recording medium. Nevertheless, the mirror 102 reflects intact in a dispersed manner the light having diverse incident angles, and does not condense the light into a particular region. Thus, irradiation energy is supplied approximately uniformly over the region of the recording medium P opposite to the flash lamp 101. Accordingly, even when high density parts and low density parts are mixed in the recording medium P, irradiation energy is supplied approximately uniformly regardless of the image density.

In contrast, in the laser fixing apparatus 31 according to the present exemplary embodiment, the laser light 33 is projected onto a limited region at the primary irradiation position 33*a*. Then, the light reflected by the recording medium is condensed and projected at the primary irradiation position. In particular, when the image density at the primary irradiation position is low, a high intensity of light is reflected by the recording medium. As such, the condenser 35 and the rear side condenser 36 are installed for a purpose different from that of the mirror in the fixing apparatus employing a flash lamp, and have a completely different function.

Next, a laser fixing apparatus according to a second exemplary embodiment of the present invention is described below with reference to FIG. 5.

Similarly to that in the first exemplary embodiment, The principal part of this laser fixing apparatus 41 is constructed from: a laser light generator 42 for projecting laser light 43 onto continuous paper P that is moving; a condenser 45 for causing scattered light 43*b* generated by the laser light 43 reflected by the continuous paper P to be projected again onto the continuous paper P; and a rear side condenser 46 for reflecting light 43*c* transmitted and scattered by the continuous paper P and thereby condensing the light 43*c* from the rear side of the continuous paper P into the irradiation position.

Here, the laser light generator 42 and the rear side condenser 46 are similar to those in the first exemplary embodiment, and hence their description is omitted. The condenser 45 is arranged between the laser light generator 42 and the continuous paper P under transport, and divided into four subunits. Then, laser light 43 enters through a gap between the divided condenser subunits 45*a* and 45*b*.

Figure 5:
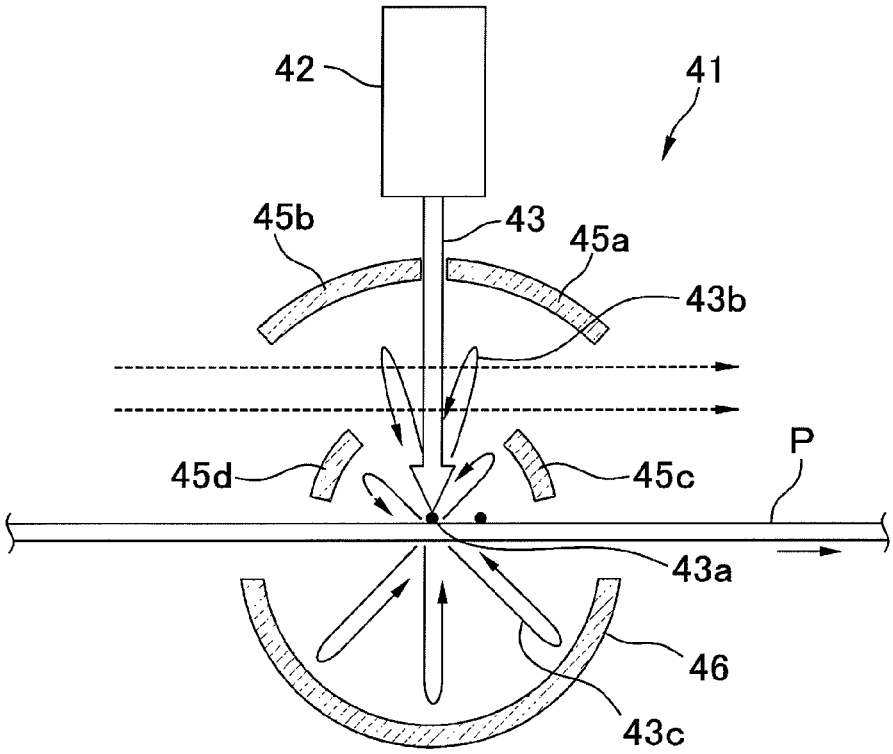
FIG. 5 is a schematic sectional view of a laser fixing apparatus employed in an image forming apparatus according to a second exemplary embodiment of the present invention.

Further, as shown in FIG. 5, the divided condenser subunits 45*a*, 45*b*, 45*c*, and 45*d* have reflecting surfaces of mutually different radii. Then, concave cylindrical surfaces opposite to the continuous paper P serve as reflecting surfaces. Here, obviously, the condenser subunits 45*a*, 45*b*, 45*c*, and 45*d* need not completely be separated from each other. That is, these subunits may be continuous at edges in the width direction of the recording medium.

The condenser subunits 45*a*, 45*b*, 45*c*, and 45*d* are arranged such that the center axis of each cylindrical surface almost agrees with the primary irradiation position 43*a* where the laser light 43 is projected directly onto the continuous paper P, or alternatively near the primary irradiation position. As a result, a major part of the light 43*b* reflected and scattered at the primary irradiation position 43*a* of the continuous paper P is reflected by the individual reflecting surfaces so as to be condensed near the primary irradiation position of the laser light 43.

Further, the condenser 45 is divided so that air ventilation parts (corresponding to a part between the condenser subunits 45*a* and 45*c* and a part between 45*b* and 45*d* in FIG. 5) that ensure a sufficient air flow between the continuous paper P and the condenser 45 are formed. This avoids stagnation of air. By virtue of this, even when suspended matter and scattered material are generated, these materials are removed by the air flow.

Figure 6:
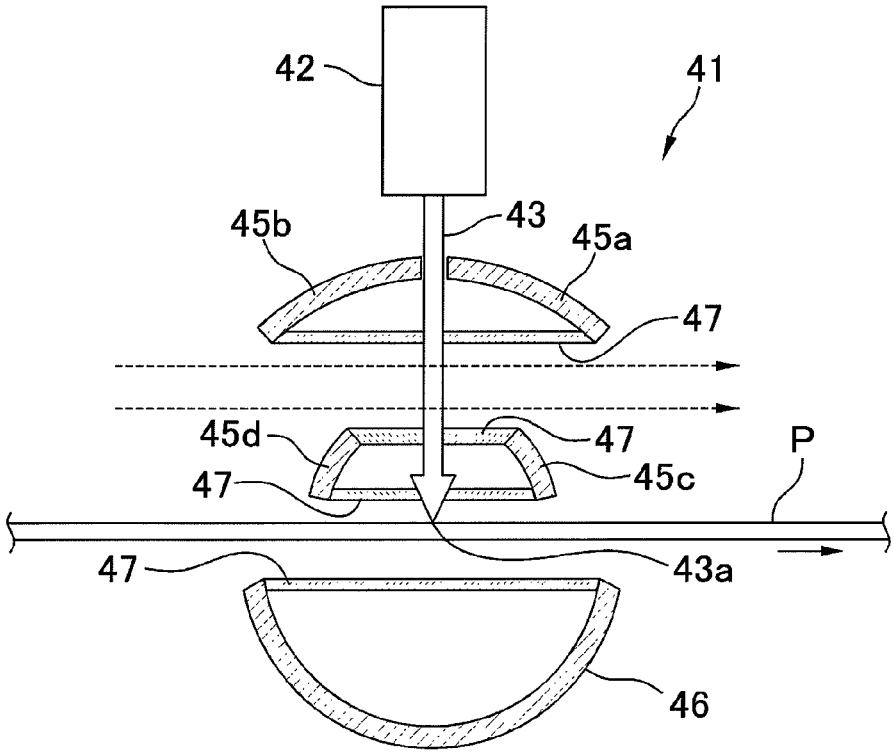
FIG. 6 is a schematic sectional view showing a variation of a laser fixing apparatus shown in FIG. 5.

FIG. 6 is a diagram showing a state that glass plates 47 each serving as a cover transparent body are arranged over the reflecting surfaces. As shown in this figure, when the reflecting surface of each divided condenser subunit 45 is covered by a glass plate 47, dirt on the reflecting surface is avoided. Further, even when dirt adheres to the glass plate 47, the dirt can be wiped off easily. This reduces the loss in the irradiation energy of the laser light 43.

In the present exemplary embodiment, the condenser 45 has been divided into four subunits. However, as long as the laser light 43 is allowed to enter and an air passage is ensured near the primary irradiation position, the number of division may be changed. Further, in the present exemplary embodiment, no air flow generator has been provided, and hence an air flow generated in association with the transport of the continuous paper P has been used. However, a blower or an aspirator for generating an air flow may be employed so that the efficiency of removal of scattered material may be enhanced further.

Next, a laser fixing apparatus according to a third exemplary embodiment of the present invention is described below with reference to FIG. 7.

Figure 7:
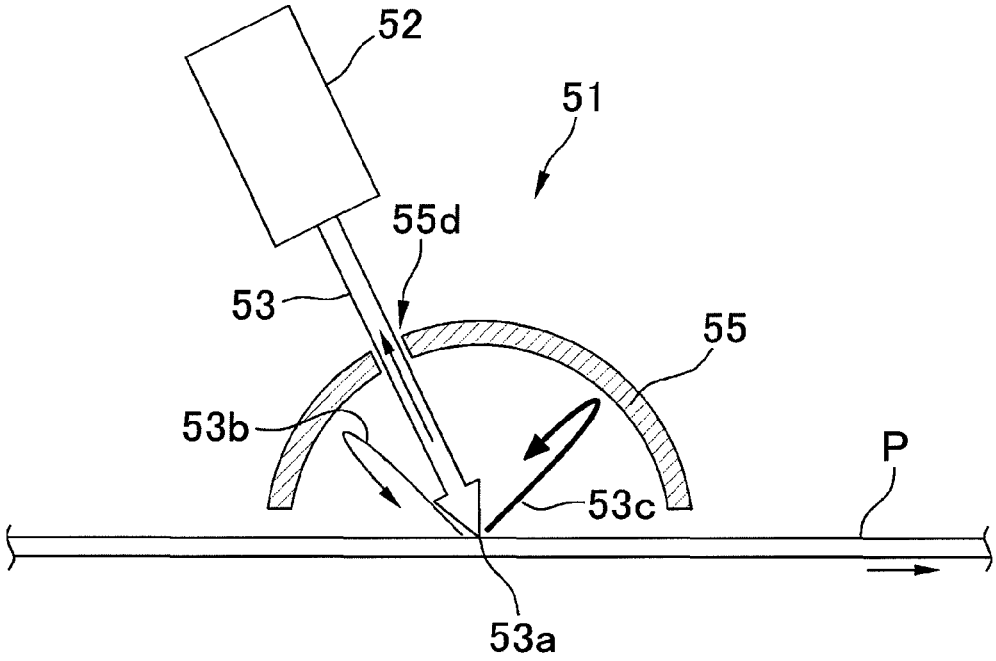
FIG. 7 is a schematic sectional view of a laser fixing apparatus employed in an image forming apparatus according to a third exemplary embodiment of the present invention.

As shown in FIG. 7, the principal part of this laser fixing apparatus 51 is constructed from: a laser light generator 52 for emitting laser light 53; and a condenser 55 for condensing, again onto the continuous paper P, scattered light 53*b* generated by the laser light 53 emitted from the laser light generator 52 and then projected onto and reflected by the continuous paper P at the primary irradiation position 53*a*.

Similarly to those in the laser fixing apparatus shown in FIGS. 2 and 3, plural of the laser light generators 52 are arranged in the width direction of the continuous paper P. Thus, laser light is projected over the entire width of the region where an image is formed in the continuous paper P under transport. Then, these laser light generators 52 are supported at a position inclined rearward in the direction of moving of the continuous paper P. As a result, laser light is projected from an inclined direction onto the surface of the continuous paper.

The condenser 55 is composed of a metal mirror whose reflecting surface opposite to the continuous paper P is a concave cylindrical surface. The condenser 55 is arranged such that the center axis of the cylindrical surface is located near the primary irradiation position 53*a* of the laser light. Then, a slit 55*d* for transmitting the laser light 53 is provided in correspondence to the position of the laser light generator 52 that projects the laser light 53 from an inclined direction and such as to cover the entire range of the width direction of the continuous paper P that is moving.

In the present exemplary embodiment, the laser light generator 52 is supported at a position inclined from a position almost perpendicular to the continuous paper P by approximately 30° rearward in the direction of moving of the continuous paper. That is, the laser light 53 is projected from a direction inclined by 30° relative to a surface perpendicular to the continuous paper P. Further, the slit 55*d* of the condenser 55 is located at a position corresponding to this.

As known in general, the light 53*b* generated by the laser light 53 reflected and scattered at the primary irradiation position 53*a* has an angular distribution shown in FIG. 7. That is, the highest intensity is obtained in the direction of light 53*c* of regular reflection, that is, in the direction where the reflection angle is equal to the incident angle. In the present exemplary embodiment, the laser light 53 is projected from a direction inclined relative to the continuous paper P. Thus, the slit 55*d* for introducing the laser light into the condenser 55 is not located in the direction of regular reflection where the reflected light 53*c* has the highest intensity. Accordingly, in comparison with an apparatus employing a condenser having an opening in the direction of regular reflection, scattered light dissipated to the outside of the condenser 55 is reduced and hence the laser light 53 loss is suppressed.

Further, even when the irradiation angle of the laser light 53 is changed as described above, the condenser 55 may be divided.

Figure 8:
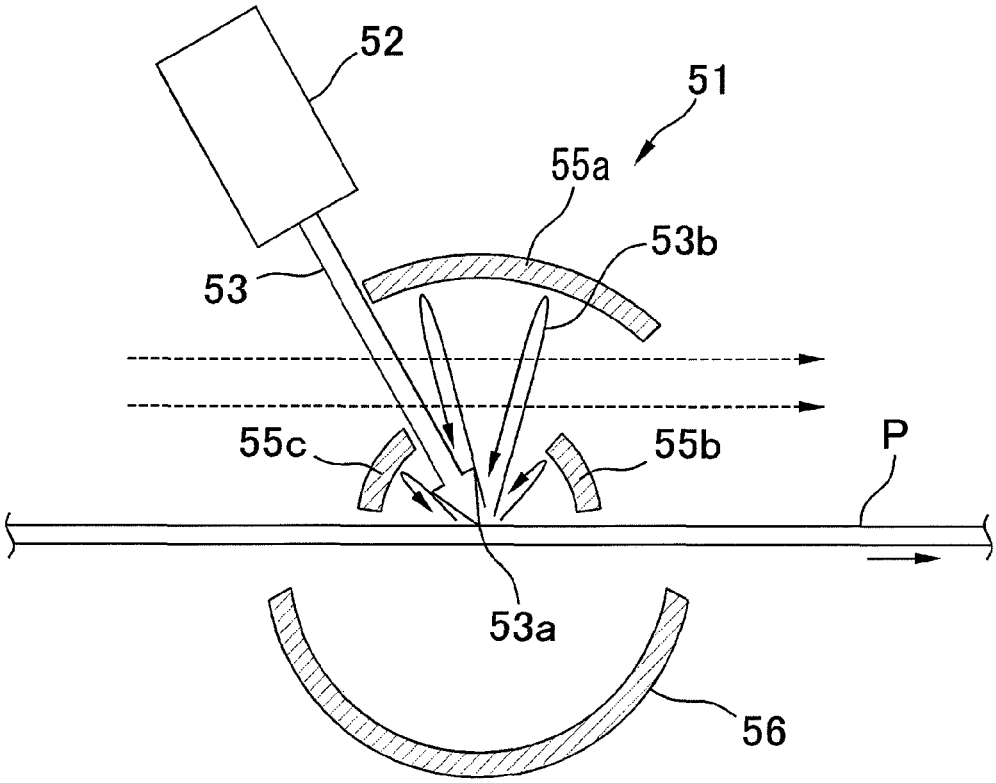
FIG. 8 is a schematic sectional view showing a variation of a laser fixing apparatus shown in FIG. 7.

In the divided condenser subunits 55*a*, 55*b*, and 55*c*, as shown in FIG. 8, the dividing positions are set up such that the laser light 53 is allowed to be projected from a position inclined relative to the continuous paper P. Further, the divided condenser subunits 55*a*, 55*b*, and 55*c* may have reflecting surfaces of mutually different inner diameters, and are arranged such that the center axes of the cylindrical surfaces agree with each other. That is, the arc of each reflecting surface in a cross section perpendicular to the center axis forms a part of any one of concentric circles. Then, the position of the center axis of these reflecting surfaces is located at the primary irradiation position 53*a* of the laser light 53 or alternatively near the primary irradiation position. As a result, the light 53*b* reflected and scattered at the primary irradiation position 53*a* is reflected by the divided condenser subunits 55*a*, 55*b*, and 55*c*, and then projected again near the primary irradiation position.

As such, when the condenser 55 is divided, an air passage is formed between the continuous paper P and the condenser 55 so that air stagnation is avoided.

Here, in the present exemplary embodiment, the irradiation angle of the laser light 53 has been inclined by approximately 30 degrees in the circumferential direction of the condenser 55 relative to the position perpendicular to the continuous paper P. However, the inclination angle may be set up appropriately.

Further, the rear side condenser 56 may be provided, and so may glass members (not shown) for protecting the reflecting surfaces of the condenser 55 and rear side condenser 56.

Here, in addition to the inclination in the circumferential direction, the laser light generator 52 may be inclined in the axis direction.

Next, a laser fixing apparatus according to a fourth exemplary embodiment of the present invention is described below with reference to FIG. 9.

Figure 9:
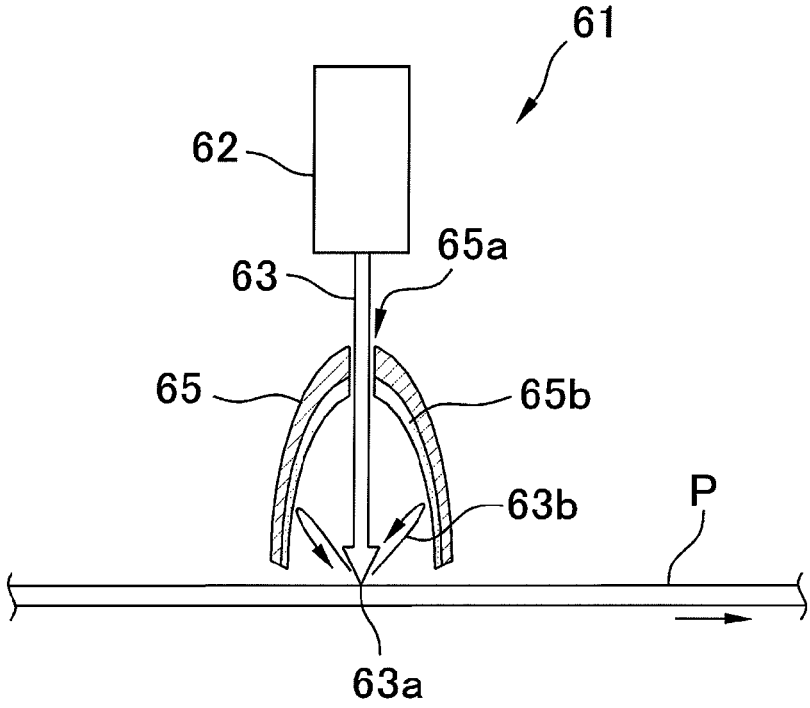
FIG. 9 is a schematic sectional view of a laser fixing apparatus employed in an image forming apparatus according to a fourth exemplary embodiment of the present invention.

As shown in FIG. 9, the laser fixing apparatus 61 has: a laser light generator 62 for projecting laser light 63 onto continuous paper P that is moving; and a condenser 65 for re-projecting, onto the continuous paper P, scattered light 63*b* generated by the laser light 63 reflected by the continuous paper P. Then, the condenser is composed of a retroreflector for reflecting incident light to almost the same direction.

The retroreflector 65 is formed in a concave shape covering the entire range of the width direction at the primary irradiation position 63*a* where the laser light is projected onto the continuous paper. Then, the retroreflector 65 is supported opposite to the continuous paper P with a gap in between. Further, a slit 65*a* into which the laser light 63 enters is provided in the width direction of the continuous paper P. Then, the laser light generator 62 is supported behind. At that time, it is preferable that the retroreflector 65 covers only the primary irradiation position 63*a* where the laser light is projected onto the continuous paper.

In the reflecting surface of the retroreflector 65, a sheet-shaped member 65*b* on which glass beads serving as retroreflector material are bonded is stuck. Scattered light 63*b* reflected at the primary irradiation position 63*a* is refracted at the time of entering the glass beads, and then reflected inside the glass beads so that reflected light is emitted almost along the same line as the incident light direction. As a result, the scattered light generated by the projection of the laser light 63 at the primary irradiation position 63*a* is condensed again at the primary irradiation position 63*a*.

Here, the laser light generator 62 is similar to that in the first exemplary embodiment, and hence its description is omitted.

In the present exemplary embodiment, the retroreflector 65 has been provided with a concave curved surface. Instead, a plane, a curved surfaces, or a combination of these may be employed. Thus, in comparison with a case that a mirror is employed, limit on the shape is relaxed remarkably. However, a shape is preferable that covers the primary irradiation position 63*a* so as to reduce the dissipation of scattered light.

Further, glass beads have been employed as retroreflector material. Instead, another publicly known retroreflector may be employed like a reflector formed by arranging a large number of small concave reflecting surfaces each having a square tapered shape.

On the other hand, a retroreflector may be employed as the rear side condenser. Further, the retroreflector may employ a glass plate or an air flow generator for dirt protection in the reflecting surface.

Next, a laser fixing apparatus according to a fifth exemplary embodiment of the present invention is described below with reference to FIG. 10.

Figure 10:
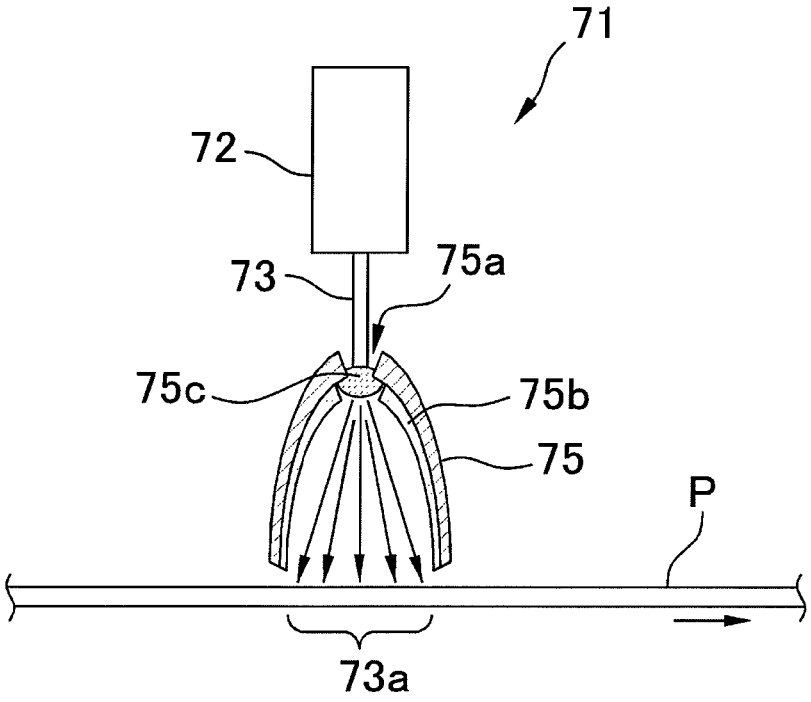
FIG. 10 is a schematic sectional view of a laser fixing apparatus employed in an image forming apparatus according to a fifth exemplary embodiment of the present invention.

As shown in FIG. 10, the laser fixing apparatus 71 has: a laser light generator 72 for projecting laser light 73 onto continuous paper P that is moving; and a condenser 75 for re-projecting, onto the continuous paper P, scattered light generated by the laser light 73 reflected by the continuous paper P. Then, the condenser is composed of a white scatterer whose concave reflecting surface reflects incident light to irregular directions.

The condenser 75 is provided such that the concave reflecting surface opposite to the surface on which toner has been transferred in the continuous paper P under transport. The condenser 75 is fabricated by applying white scattering material onto the reflecting surface. Then, the transport-directional length of the region where the concave surface on which the white scatterer layer 75*b* is provided covers the image surface of the continuous paper P is set to be almost the same as the beam width 73*a* of the laser light 73 in the direction of transport of the continuous paper P, or alternatively slightly larger than the beam width. Further, in the width direction of the continuous paper P, almost the entire range where the laser light 73 is projected is covered. Furthermore, in correspondence to the path of the laser light projected from the laser light generator 72, a slit 75*a* is provided in the condenser. Then, through this slit 75*a*, the laser light 73 is projected onto the continuous paper P in the width direction. As shown in FIG. 10, a lens 75*c* may be provided in the slit 75*a* so that the irradiation range of the laser light 73 in the transport direction may be adjusted.

Here, the laser light generator 72 has the same configuration as that in the first exemplary embodiment, and hence its description is omitted.

In the laser fixing apparatus 71 having the above-mentioned configuration, the laser light 73 projected onto the continuous paper P is reflected and scattered at the primary irradiation position, and then reaches the white scatterer layer 75*b* of the condenser. The white scatterer layer 75*b* scatters the scattered light in arbitrary directions. Then, reflection is repeated within the region surrounded by the white scatterer, and then the light is projected onto the region of the continuous paper P opposite to the white scatterer layer 75*b*.

Thus, in a case that the beam width 73*a* range where the laser light 73 is projected is a low density part, when the laser light 73 is projected, a higher intensity of light is reflected by the continuous paper. Then, the light is reflected within a narrow region on the continuous paper covered by the white scatterer layer 75*b*, that is, within the irradiation region of the laser light or alternatively a region slightly larger than this, and then is projected onto the low density part on the continuous paper. In contrast, in a case that the beam width 73*a* range where the laser light 73 is projected is a high density part, when the laser light is projected, a lower intensity of light is reflected by the continuous paper. Then, a lower intensity of energy is reflected by the white scatterer layer 75*b* and projected onto the high density part on the continuous paper. As a result, toner is sufficiently heated and fixed satisfactory in low density parts, while poor fixing caused by excessive heating is suppressed in high density parts. Even such a mode shall be included in the definition of "condensing" in the present invention.

EXAMPLES

Next, description is given for the result of simulations on the irradiation energy of laser light in a laser fixing apparatus provided with a condenser and a rear surface condenser.

Here, it should be noted that the present invention is not limited to the present examples. As shown in FIG. 3, simulations are carried out for the energy projected onto each sample image in a case that five sample images are irradiated with infrared light having a wavelength of approximately 800 by using a laser fixing apparatus provided with a condenser and a rear side condenser formed such that the center axis of the cylindrical surfaces is located near the primary irradiation position of the laser light.

The five samples are as follows.

(1) solid black (black toner with an area coverage of 100%)

(2) solid secondary color (toner of any two colors selected from cyan, magenta, and yellow toners, with an area coverage of 100%)

(3) solid primary color (toner of any one color selected from cyan and magenta, with an area coverage of 100%)

(4) highlight part (low density part)

(5) isolated toner particles (toner isolated into individual particles)

Figure 11:
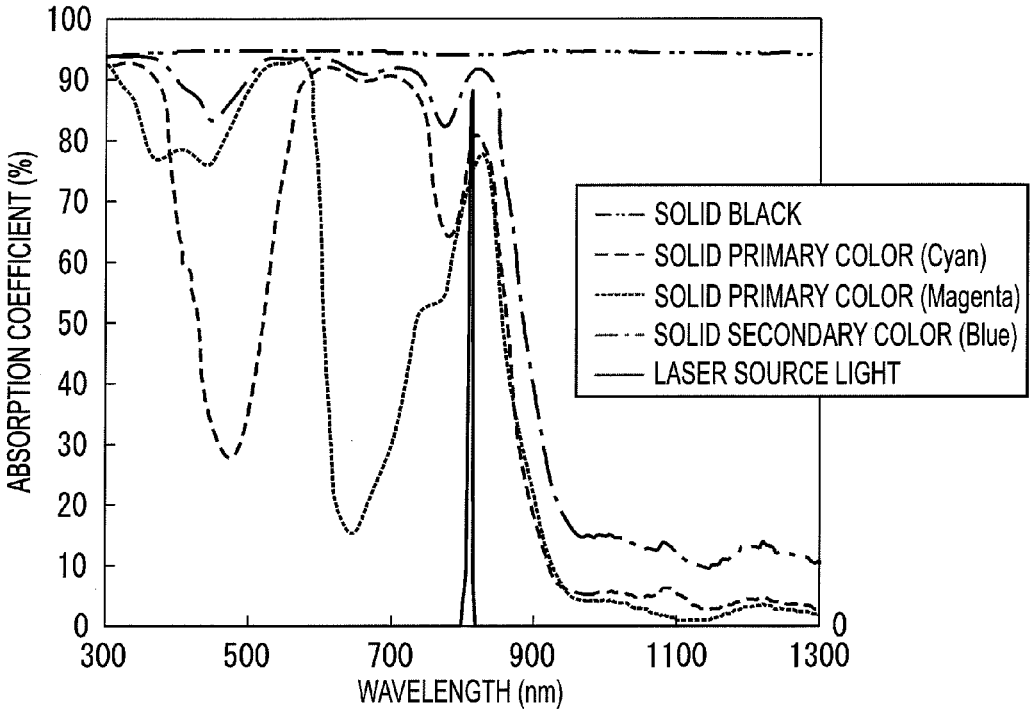
FIG. 11 is a diagram showing the utilization efficiency of the irradiation energy of laser light achieved by a condenser and a second condenser.

Here, an infrared absorption agent is added to each toner. As shown in FIG. 11, the designed absorption coefficient in the case of irradiation of laser light of 800 nm is (1) approximately 95% for solid black, (2) approximately 90% for solid secondary color, and (3) approximately 78% to 80% for solid primary color. Further, (4) highlight part (low density part) had an absorption coefficient of approximately 10%, and (5) isolated toner particles had an absorption coefficient of approximately 2%.

Here, the absorption coefficient of the highlight part (low density part) and the absorption coefficient of the image having isolated toner particles are expressed by (area coveragex absorption coefficient of irradiation energy of laser light by toner). The area coverage indicates the fraction of an area covered by toner within an image.

Thus, the irradiation energy absorbed when the laser light is primarily projected onto each sample described above has the value given above.

Figure 12:
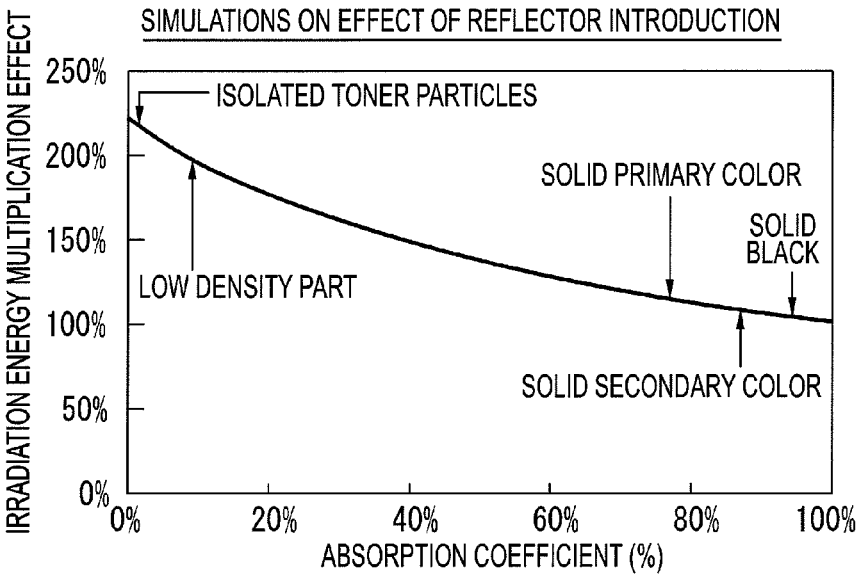
FIG. 12 is a diagram showing the wavelength dependence of the absorption coefficient of solid black, solid primary color, and solid secondary color.

The result of simulations is as shown in FIG. 12. That is, the energy projected onto each sample from the laser fixing apparatus provided with a condenser and a rear side condenser is as follows.

Here, the following values are normalized by adopting as 100% the energy directly projected from the laser generator, that is, the primary irradiation energy. Further, the horizontal axis indicates the absorption coefficient of the primary irradiation energy.

(1) solid black: approximately 101%

(2) solid secondary color: approximately 105%

(3) solid primary color: approximately 120%

(4) highlight part (low density part): approximately 195%

(5) isolated toner particles: approximately 220%

The result indicates that when the laser light is projected onto solid black, the sum of the energy projected onto the toner particles in the primary projection of the laser light and the irradiation energy of the reflected light projected again onto the toner particles is 101% of the primary irradiation energy. Thus, in this case, merely a small increase is obtained in the irradiation energy even when the condenser and the rear side condenser are provided.

In contrast, as for the sample to which isolated toner particles had adhered, it is indicated that the sum of the energy projected onto the toner particles in the primary projection of the laser light and the irradiation energy of the reflected light projected again onto the toner particles is 220% of the primary irradiation energy.

As seen from these results, by virtue of the condenser and the rear surface condense employed in the laser fixing apparatus according to the present invention, twice the irradiation energy in the high density part is imparted to the toner particles in the highlight part (low density part) serving as a low density part and in the isolated toner particles.

This shows that an irradiation energy necessary for satisfactory fixing is imparted to the toner in a low density part (highlight) and to isolated toner particles, where a high intensity of light is reflected at the primary irradiation position of the laser light or a high intensity of light is transmitted through the continuous paper P and hence a difficulty is present in heating by the irradiation energy.

In contrast, in high density parts, a low intensity of light is reflected at the primary irradiation position or a low intensity of light is transmitted through the recording medium. Thus, approximately 101% of the irradiation energy is merely imparted and hence excessive heating does not occur.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A laser fixing apparatus comprising:

a laser light generator that generates laser light to be projected onto a recording medium;

a first condenser that reflects and condenses light generated by reflection of the laser light projected at an irradiation position of the recording medium, such that the reflected and condensed light is re-projected at the irradiation position and/or near the irradiation position; and a second condenser that reflects and condenses light having been transmitted through the recording medium as a result of the laser light projected onto the recording medium, such that the transmitted light is projected onto (i) a rear surface of the recording medium at the irradiation position and/or (ii) the rear surface near the irradiation position.

2. The laser fixing apparatus according to claim 1, wherein the laser light enters through an entrance opening in the first condenser, and is projected onto the recording medium.

3. The laser fixing apparatus according to claim 1, wherein the first condenser and/or the second condenser has a concave cylindrical surface, and the first condenser and/or the second condenser is supported such that a position of a center axis of the cylindrical surface is located at the irradiation position and/or near the irradiation position.

4. The laser fixing apparatus according to claim 1, further comprising:

an air ventilation part in the first condenser and/or the second condenser to promote air flow.

5. The laser fixing apparatus according to claim 1, wherein a reflecting surface of the first condenser and/or the second condenser is composed of a retroreflector.

6. The laser fixing apparatus according to claim 1, wherein a reflecting surface of the first condenser and/or the second condenser is composed of a white scatterer.

7. The laser fixing apparatus according to claim 1, wherein the laser light generator is provided at an inclined position with respect to a moving direction of the recording medium, and the laser light generator projects the laser light directly onto the recording medium in an inclined direction relative to a surface perpendicular to the recording medium.

8. An image forming apparatus comprising:

an image carrier on which an electrostatic latent image is formed by a difference in electrostatic charging potentials;

a developing unit that transfers image forming material to the electrostatic latent image formed on the image carrier so as to form a visible image;

a transfer unit that transfers the visible image directly onto a recording medium or alternatively performs primary transfer of the visible image onto a transfer body and secondary transfer onto the recording medium; and the laser fixing apparatus according to claim 1 that heats and fixes the image forming material of the visible image transferred on the recording medium.

* * * * *